US005197764A

United States Patent [19]

Hicinbothem et al.

[11] Patent Number: 5,197,764

[45] Date of Patent: Mar. 30, 1993

[54] ALPHANUMERIC COLOR-CODED FILING METHOD AND SYSTEM THEREFOR

[75] Inventors: Joseph S. Hicinbothem, Kettering; Jack W. Jeter, Akron, both of Ohio

[73] Assignee: The Reynolds and Reynolds Company, Dayton, Ohio

[21] Appl. No.: 727,848

[22] Filed: Jul. 11, 1991

[51] Int. Cl.[5] ..... B42D 15/00

[52] U.S. Cl. ..... 283/81; 40/359; 40/360; 229/1.5 R; 283/36; 283/70; 283/114

[58] Field of Search ..... 283/36, 70, 81, 114; 40/359, 360; 229/1.5 R, 69 R, 75

[56] References Cited

U.S. PATENT DOCUMENTS

| | | | |
|---|---|---|---|
| 2,374,695 | 5/1945 | Murray . | |
| 3,737,046 | 6/1973 | Jeter . | |
| 3,937,493 | 2/1976 | Fasbender | 40/359 X |
| 4,329,191 | 5/1982 | Barber | 283/36 X |
| 4,364,586 | 12/1982 | Ott | 40/360 X |
| 4,580,815 | 4/1986 | Barber | 283/81 |
| 4,585,253 | 4/1986 | Beisswanger | 283/36 X |
| 4,586,820 | 8/1989 | Kasprzak et al. | 283/114 X |
| 4,715,621 | 12/1987 | Colavito et al. | 283/36 |
| 5,083,816 | 1/1992 | Folga et al. | 283/114 X |

OTHER PUBLICATIONS

Jeter Systems Corporation, "The Jeter Color-Coded Filing Systems for Auto Dealership Service Departments," Promotional pamphlet AD-122, 1985.

*Primary Examiner*—Paul A. Bell

*Attorney, Agent, or Firm*—Mason, Fenwick & Lawrence

[57] ABSTRACT

An alphanumeric color-coded filing system comprising a plurality of coded labels of different sizes having visually-perceptible characteristics corresponding the specific alphanumeric information and a folder having a front and back cover. The back cover has a unitary flap extending substantially the entire length thereof outwardly of the corresponding edge of the front cover, and the flap has a unitary tab extending outwardly therefrom along a portion of its length. The flap including the tab is marked with a plurality of placement guides corresponding in size to the front section of the labels. The placement guides on the tab are all the same size for guiding placement of labels of the same size. The tab defines a location for the placement of primary information, while the remaining portions of the flap defines locations for the placement of supplemental information.

9 Claims, 3 Drawing Sheets

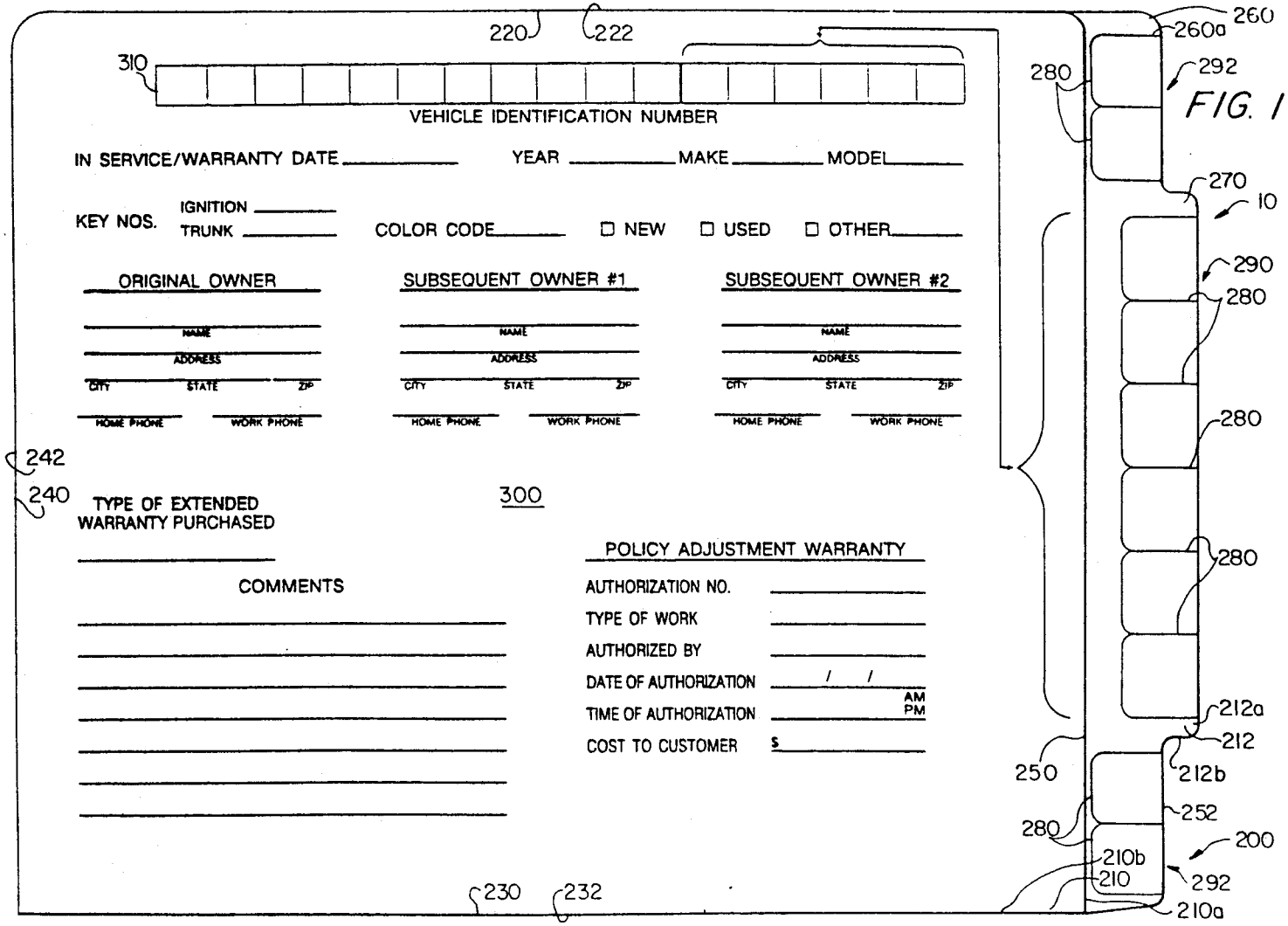
FIG. 1
VEHICLE IDENTIFICATION NUMBER
IN SERVICE/WARRANTY DATE
YEAR
MAKE
MODEL
KEY NOS.
IGNITION
TRUNK
COLOR CODE
NEW
USED
OTHER
ORIGINAL OWNER
SUBSEQUENT OWNER #1
SUBSEQUENT OWNER #2
NAME
ADDRESS
CITY
STATE
ZIP
HOME PHONE
WORK PHONE
TYPE OF EXTENDED WARRANTY PURCHASED
COMMENTS
POLICY ADJUSTMENT WARRANTY
AUTHORIZATION NO.
TYPE OF WORK
AUTHORIZED BY
DATE OF AUTHORIZATION
TIME OF AUTHORIZATION
AM
PM
COST TO CUSTOMER
$
300
10
200
210
210a
210b
212
212a
212b
220
222
230
232
240
242
250
252
260
260a
270
280
290
292

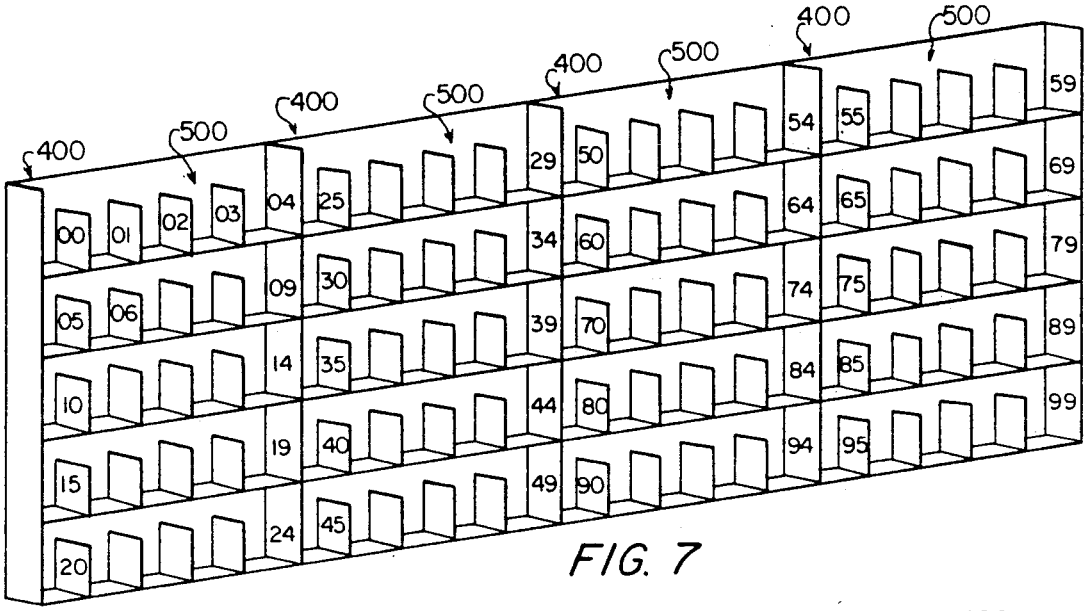
FIG. 7
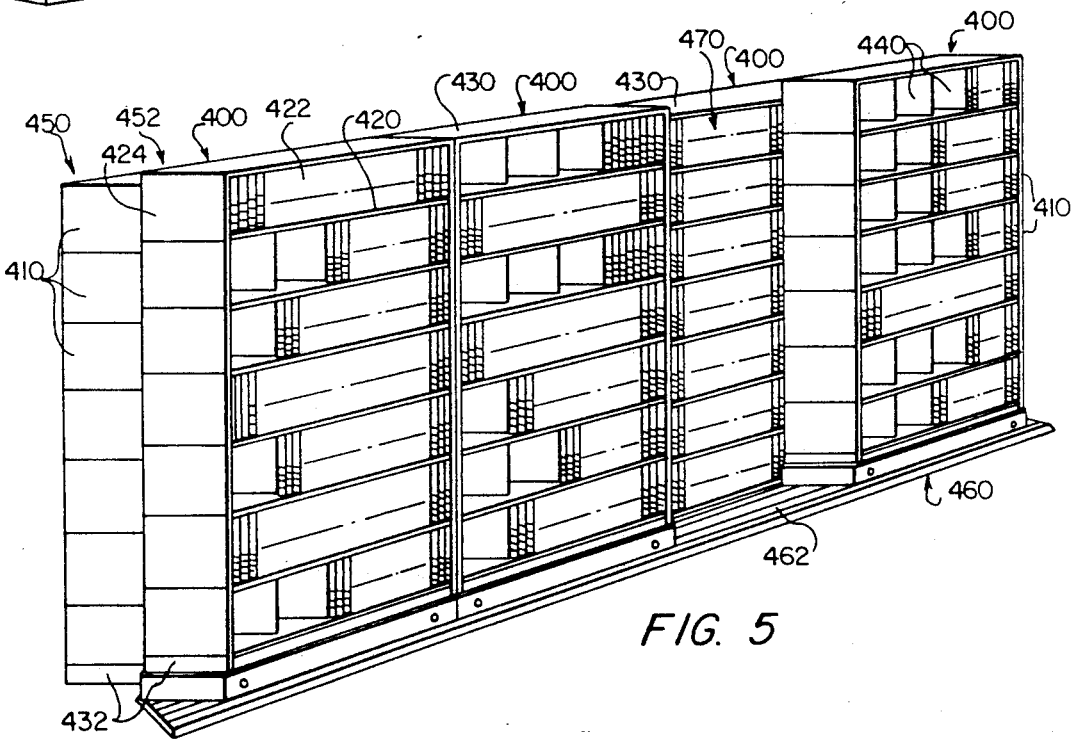
FIG. 5
FIG. 6
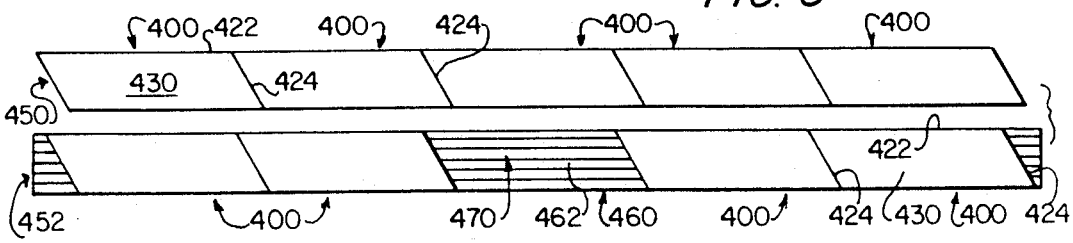

ALPHANUMERIC COLOR-CODED FILING METHOD AND SYSTEM THEREFOR

BACKGROUND OF THE INVENTION

1. Field Of The Invention

The present invention relates to a method for filing folders using color-coding corresponding to specific alphanumeric information and a system for implementing the method.

2. Related Art

A number of filing systems are known in which alphanumeric, color-coding is used. U.S. Pat. Nos. 4,240,848 and 4,329,191 to Barber are representative. Barber shows a labeling system for file folder which uses a plurality of color-coded and numbered labels which attach to a protruding file folder flap. In addition, a label is printed which identifies the subject matter of the article on one or more individual labels corresponding to the letters or number on the color-coded labels.

U.S. Pat. No. 4,580,815 to Barber and U.S. Pat. No. 4,715,621 to Colivito et al disclose the use of numeric, color-coded labels which are adhesively attached to the right vertical edge of a file folder using an extension member which is itself attached to the file folder. Colivito et al also disclose the use of pre-printed material on the extension concerning the contents of the file, as well as sufficient blank space for entering additional information.

U.S. Pat. No. 2,374,695 to Murray discloses the use of a file folder with multiple foldable index tabs.

As illustrated by the Barber and Colivito et al patents, prior art alphanumeric color-coded filing systems generally use labels which are arranged in a linear fashion. A similar system with labels arranged in a linear fashion has been used by Jeter Systems Corporation of Akron, Ohio for vehicle service records. Although such an arrangement is useful where the linearly-arranged labels represent a single item of information, such as an identification number, it may result in visual confusion where they represent multiple items of information. Also, individual labels may be difficult to see when multiple file folders are arranged next to each other on a shelf or in a drawer.

Furthermore, none of the filing systems disclosed by the above patents is suitable for use by automobile dealerships for the filing of vehicle information. Generally, there are three major files in automobile dealerships, sales files, accounts receivable and payable files, and service files. Sales files comprise jackets which contain all of the order papers, contracts, and related sales papers. Because the purchaser of the vehicle is of primary importance in the sales context, sales files are filed alphabetically by last name. Sales files are accessed by the dealer less often than are other files.

Accounts receivable and payable files are accessed more often than sales files. However, the service files are generally the largest and most often accessed files in a dealership and therefore are most in need of an effective and efficient filing system. Because the service file is referenced in most dealerships every time a vehicle arrives for service, the files are located as physically close to the service drive as possible, often at the side of or near the service drive or in the service manager's office, where floor space is at a premium.

Each service file generally contains the relevant information about the vehicle, including a detailed list of the factory-installed and dealer-installed options, which is necessary for warranty claims, and a comprehensive service history as recorded by the repair orders. Supplemental information can also be included about the owner. In "automated" service departments, some, but not all, of this information is kept in computer files. Dealerships generally cannot afford to have enough computer memory to store all of the information kept in the service files. In addition, the "keying" time required to input all of the information into the computer would be expensive and time consuming. Therefore, only the major items on the repair orders are generally kept "on line" for fast access. The "hard copy" in the service files is used for detailed information.

Typically, a service file is created when the dealership receives a new vehicle, in anticipation of repeat service work, or when a new customer brings in a vehicle for "walk-in" service. Tax laws, state laws, and manufacturer requirements generally make it necessary for the dealership to retain service records for five years, sometimes more, after the service work was performed. Thus, service files can consume large amounts of space.

In general, there are two basic methods used by dealerships for filing service records: the customer's last name and the vehicle identification number (VIN). In nonautomated service departments, the dealer has the option of using either. However, in an automated service department, the files are almost always kept according to the VIN.

The better of the two methods is to file according to the VIN, for two reasons. First, all computer systems use the VIN as the primary method of identifying a car. Second, the vehicle could have multiple owners, which would necessitate opening a new file each time the vehicle is transferred. Information could also be lost if the dealer is not aware that the previous owner used the dealership for service work.

However, filing by the entire VIN has a number of substantial drawbacks. For example, the VIN for all 1981 and subsequent model year vehicles consists of 17 letters and numbers, too many characters to work with conveniently. Also, the first three letters and numbers, which identify the country of origin, the manufacturer, and the type of vehicle, are likely to be duplicative for many of the vehicles at any one dealership, providing information which is of no particular use in identifying individual vehicles, and which does not aid in filing.

It is therefore a primary object of the present invention to provide an alphanumeric color-coded filing system in which different items of information are readily distinguishable and which provides unique identification of each file.

It is another object of the present invention to provide a method which employs the system according to the invention for effectively and efficiently filing files according to a substantially random identification number.

SUMMARY OF THE INVENTION

These and other objects of the invention are achieved by the provision of an alphanumeric color-coded filing system comprising a plurality of coded labels having visually-perceptible characteristics corresponding to the specific alphanumeric information and a folder having a front and back cover, the back cover having a unitary flap extending substantially the entire length thereof outwardly of the corresponding edge of the front cover, and the flap having a unitary tab extending outwardly therefrom along a portion of its length. In one aspect of the invention, the tab is centrally located along the flap.

The flap including the tab is marked with a plurality of placement guides corresponding in size to the front section of the labels for guiding placement of the front section of the labels on the front face of the flap. The tabs define a location for the placement of primary information, while the remaining portions of the extension define locations for the placement of supplemental information.

In the method according to the invention, the primary information on the folder comprises a substantially random number having at least $x_1$ digits, each of the random numbers preferably having the same number of digits, and at least one shelf is provided which is divided into a plurality of imaginary or real bins which are assigned sequential numbers having at least $x_2$ digits, each of the sequential numbers having the same number of digits and $x_1$-$x_2$ being at least 1. Each folder is assigned to one of the bins based on the last two digits of the number comprising the primary information. Folders within each bin are arranged sequentially according to their numbers.

In the method as applied to folders for storing automobile service records and the like, the random numbers are the last six digits of the VIN, and $x_2$ is at least 2, the first sequential number being "00".

BRIEF DESCRIPTION OF THE DRAWINGS

The invention is better understood by reading the following detailed description of the preferred embodiments with reference to the accompanying drawing of figures, in which like reference numerals refer to like elements throughout, and in which;

FIG. 1 is a front view of a folder for use with the alphanumeric color-coded filing system in accordance with the invention.

FIG. 5 is a perspective view of a set of cabinets for use with the alphanumeric color-coded filing system in accordance with the present invention.

FIG. 6 is a top plan view of the set of cabinets shown in FIG. 5.

FIG. 7 is a diagrammatic view illustrating the method according to the invention.

DETAILED DESCRIPTION OF A PREFERRED EMBODIMENT

Figures 2, 3, 4A, 4B, 4C, 4D, 4E, 4F, 4G:
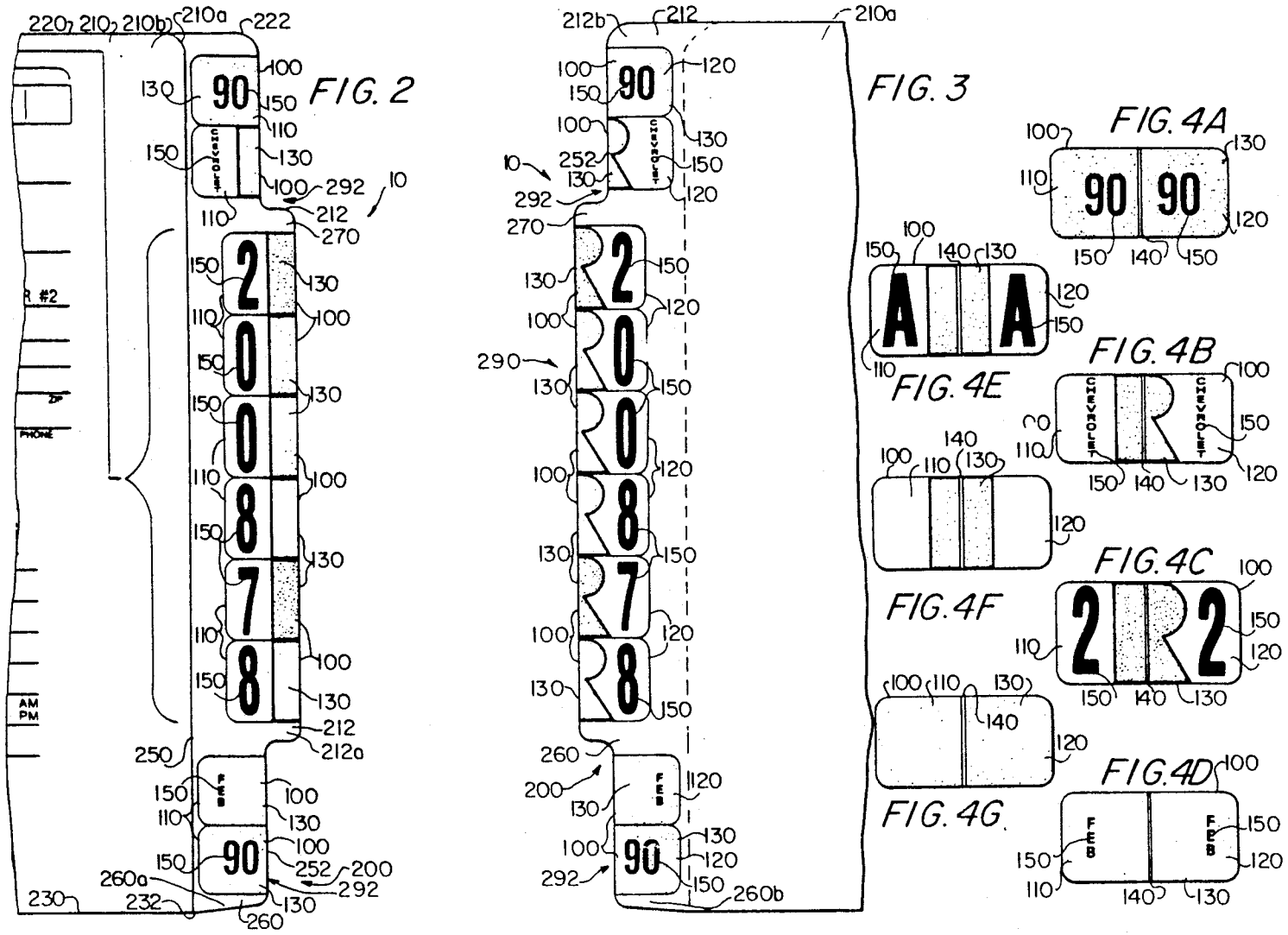
FIG. 2 is a partial front view of the folder of FIG. 1 to which labels have been attached in accordance with the invention.
FIG. 3 is a back view of the folder with labels attached as shown in FIG. 2.
FIG. 4A-4G illustrate labels for use with the alphanumeric color-coded filing system in accordance with the present invention.

In describing the preferred embodiment of the present invention illustrated in the drawings, specific terminology is employed for the sake of clarity. However, the invention is not intended to be remitted to the specific terminology so selected, and it is to be understood that each specific element includes all technical equivalents which operate in a similar manner to accomplish a similar purpose.

Referring now to FIGS. 1-3 there is shown an alphanumeric color-coded filing system 10 according to the invention. Filing system 10 comprises a plurality of alpha-numeric color-coded labels 100*a*-100*g* shown in FIGS. 4A-4G, which can be applied to a folder 200 as shown in FIGS. 2 and 3.

Each of labels 100*a*-100*g* has a respective front section 110*a*-100*g*, a respective back section 120*a*-120*g*, and a respective color-coded section 130*a*-130*g* which overlaps at least a portion of respective front and back sections 110*a*-110*g* and 120*a*-120*g*. As shown in FIGS. 4A-4G, front and back sections 110*a*-110*g* and 120*a*-120*g* can be separated by a respective fold line 140*a*-140*g*. As further shown in FIGS. 4A-4E labels 100*a*-100*g* can have alphanumeric information printed or otherwise marked thereon. By alphanumeric information is meant information which may be alphabetic only, or numeric only, or both alphabetic and numeric.

Respective color-coded section 130*a*-130*g* can cover the entirety of respective front and back sections 110*a*-110*g* and 120*a*-120*g*, as shown in FIGS. 4A, 4D, and 4G, or it may cover only those portions of respective front and back sections 110*a*-110*g* and 120*a*-120*g* adjacent folds 140*a*-140*g*, as shown in FIGS. 4B, 4C, 4E, and 4F. Additionally, the color-coded section can take the form of a rectangular strip, as shown at 130*e* and 130*f* in FIGS. 4E and 4F, or as shown in FIGS. 4B and 4C the, color-coded can even take the form of a logo or design as shown at 130*b* and 130*c*. As also shown in FIGS. 4A-4E, the alphanumeric information marked on labels 100*a*-100*c* can be of any desired type. For example, as shown in FIG. 4A, two digits representing the last two numbers of a year are marked on label 100*a*. In FIG. 4B, a make of automobile is marked on label 100*b*. In FIG. 4C, a single digit for a purpose to be described hereinafter is marked on label 100*c*. In FIG. 4D, an abbreviation for a month is marked on label 100*d*. In FIG. 4E, a single letter is marked on label 100*c*. Alternatively, as shown in FIGS. 4F and 4G, the label can be left blank having a color-coded section only, in order for the user to be able to assign his own designation thereto.

Preferably, labels 100*a*-100*g* are self-adhesive with a protective Mylar TM covering over the front and back sections 110*a*-100*g* and 120*a*-120*g*. Labels 100*a*-100*g* also can be different sizes. For example, as shown in FIGS. 2, 3, and 4A-4G, label 100*c* marked with a single numeral can be longer and wider than labels 100*a*, 100*b*, and 100*d*-100*g* marked with other alphanumeric information or left blank.

Referring now to FIGS. 1-3, folder 200 comprises a front cover 210 having inner and outer faces 210*a* and 210*b*, and a back cover 212 having inner and outer faces 212*a* and 212*b*. Front and back covers 210 and 212 are substantially rectangular, and are in alignment along three of their edges, but are unaligned along the fourth of their edges. As shown in FIG. 1, front and back 210 and 212 have top edges 220 and 222, respectively, which are in alignment, bottom edges 230 and 232, respectively, which are are in alignment, side edges 240 and 242 which are in alignment, and side edges 250 and 252, respectively, which are not in alignment.

Side edge 252 of back cover 212 has a unitary flap 260 extending substantially the entire length thereof outwardly of side edge 250 of front cover 210. Flap 260 has inner and outer faces 260*a* and 260*b* which are unitary with inner and outer faces 212*a* and 212*b*, respectively, of back cover 212. A unitary tab 270 extends outwardly from flap 260 along a portion of its length. Preferably, tab 270 is centrally located on flap 260, having its edges inset from the edges of flap 260.

A plurality of placement guides 280 are marked on inner face 260*a* of 260, which correspond in size to the respective front sections 110*a*–110*g* of labels 100*a*–100*g* for guiding the placement of the front sections 110*a*–110*g* of labels 100*a*–100*g* onto inner face 260*a* of flap 260. At least some of placement guides 280 are positioned on tab 270. As can be seen from FIGS. 2 and 3, inner and outer faces 260*a* and 260*b* of flap 260 have sufficient width to receive front and back sections 110*a*–110*g* and 120*a*–120*g*, respectively, of labels 100*a*–100*g*. Also, as can best be seen from FIGS. 2 and 3, when labels 100*a*–100*g* are in place on folder 200, color-coded sections 130*a*–130*g* are adjacent to side edge 252 of back cover 212, to increase their visual perceptibility.

In particular, placement guides 280 on tab 270 define a primary information-receiving area 290, while placement guides 280 on the remaining portion or portions of flap 260 define supplementary information-receiving areas 292 on either side of primary information-receiving area 290. Primary information-receiving area 290 is more visually prominent than supplementary information-receiving areas 292.

Referring again to FIG. 1, a form 300 can be provided on outer face 210*b* of front cover 210 for the entry of at least some of the alphanumeric information 150*a*–150*c* represented by labels 100*a*–100*c*. With particular preference to a filing system for use by automobile dealerships and a method in accordance with the invention of implementing the filing system, form 300 has spaces 310 for entry of the last six numbers of the VIN. Spaces can also be provided as shown for the year, make, and model of the vehicle, information about the original and subsequent owners, and warranty and other information.

The last six numbers of the VIN are the primary information by which folders 200 are filed in accordance with the present method, and therefore primary information-receiving area 290 has six placement guides 280 for receiving six labels 100*c* with single numbers or letters thereon of the type shown on FIG. 4*c*. The supplementary information-receiving areas 292 have placement guides 280 for the receipt of labels of the type shown on FIG. 4A, to designate the model year of the automobile, a label of the type shown in FIG. 4B, to indicate the make of the automobile, and a label of the type shown in FIG. 4D to indicate the month the automobile was last serviced. Labels of the type shown in FIGS. 4F–4G can be substituted for any of those labels 100*a*–100*c* in supplementary information-receiving areas 292 to suit the needs of the automobile dealership. As can be seen from FIGS. 2 and 3, because alphanumeric information 150*a*–150*c* on each of labels 100*a*–100*c* is marked on both front and back sections 110*a*–110*c* and 120*a*–120*c*, it is visible from both the front and back of folder 200. Thus, the alphanumeric information is visible to the user whether folder 200 is viewed from the front or the back. The last six numbers of the VIN provide a convenient way of referencing the numerous vehicle in an automobile dealership, in accordance with the method to be described hereinafter. The color-coding provided by labels 100*c* on primary information-receiving area 290 make misfiling easy to identify.

It will also be appreciated by those of skill in the art that labels 100*a*–100*g* and folder 200 can be adapted for other uses, such as, for example, medical records. In that case, primary information 290 can be used for a patient identification number, for example, and form 300 can include spaces for the entry of the patient identification number.

Referring now to FIGS. 5 and 6, there is shown a set of cabinets 400 for use in filing folders 200 in accordance with the method of the invention. Each of cabinets 400 comprises a plurality of modular shelves 410 which are stacked to form a cabinet 400. Similar shelves are disclosed in U.S. Pat. No. 3,737,046 to Jeter.

Each shelf 410 comprises a horizontal bottom wall 420, a vertical back wall 422 perpendicular to bottom wall 420, and a pair of opposed vertical side walls 424 also perpendicular to bottom wall 420. Bottom wall 420 is in the shape of a parallelogram, for a purpose to be described hereinafter, so that one of side walls 424 forms an acute angle with back wall 422, preferably an angle of approximately 55°, while the other of side walls 424 forms an obtuse angle with back wall 422, preferably an angle of approximately 125°.

Shelves 410 are open at the top. Therefore, when they are stacked to form a cabinet 400, a top section 430 is placed over the uppermost shelf 410 to close it off. In addition, a base 432 is provided under the bottommost shelf 410 in order to lift cabinet 400 off the floor. In order to add rigidity to cabinets 400 and to prevent undue shifting of folders 200 once placed on shelves 410, each shelf is provided with a plurality of dividers 440 welded to bottom and back walls 420 and 422. Preferably, three dividers 440 are used.

Depending upon the amount of storage space needed, cabinets 400 can be placed side-by-side and even in rows. When placed in rows, the first or rear row 450 is fixed, and the second or front row 452 rolls on a conventional track system 460, in a known manner. For example, each cabinet 400 can be mounted on a track 462 by means of a wheeled carriage 464.

As can be seen from FIGS. 5 and 6, front row 452 has at least one less cabinet 400 than rear row 450. As a result, front row 452 has a "hole" or space 470 therein, through which cabinets 400 in rear row 450 can be accessed by moving the individual cabinets 400 in front row 452. Because side walls 424 are at an angle to back wall 422, when a plurality of folders 200 are placed side-by-side in a shelf 410 with their tabs 270 facing out, folders 200 are stored at an angle to the front of shelf 410. This storage angle makes alphanumeric information 150*a*–150*c*, and particularly that alphanumeric information 150*c* in primary information-receiving area 290, easily visible, because tab 270 of each folder 200 is inset from that of the succeeding folder and extends beyond that of the preceding folder.

The method of filing folders 200 containing vehicle information in accordance with the invention will now be described. The basis of the present method of filing is the segmentation of folders 200 into substantially consistently sized groups which can then be organized in a file area so that each group is always located in the same place. Because the location of each folder 200 is predictable, it can be accessed quickly, resulting in lower labor costs and greater efficiency. Also, because the primary alphanumerical information 150 by which folders 200 are filed is color-coded, routine visual searches of the color codes will identify any incorrectly filed folders 200 in a given group, eliminating the potential for misfiled folders. Because of the relatively small number of folders 200 in each group, a misfiled folder within a group can be identified quickly.

The method in accordance with the invention is based upon the use of a series of substantially random numbers, in the case of an automobile dealership, the last six digits of the VIN as the filing criteria. The last six digits of the VIN is a sequential number assigned to each car manufactured with the same specifications. These six digits therefore are only partially random. Because the numbers are issued sequentially, they have an apparent randomness resulting from "breaks" in the numbering system. These breaks are the result of a dealer receiving a very small part of the total production of a particular vehicle series, usually in random order. However, if a fleet of 25 vehicles of the same model were ordered all at one time for one customer, the vehicle VIN's would most likely come in sequential order with no breaks.

The segmentation of folders 200 into substantially consistently sized groups in accordance with the present method is accomplished by dividing the total filing space, in this case shelves 410, into small bins 500, which can be real or imaginary. Bins 500 are assigned sequential numbers having the same number of digits, the first of the sequential numbers being "0". As will be described in greater detail hereinafter, the number of digits in the sequential numbers determines the number of folders 200 which will be stored in each bin 500. For most dealerships, two-digit numbers starting with "00" are used.

Numbers are assigned sequentially from left to right for each bin 500, either by individual cabinet 400, by working downward from top to bottom for each shelf 410 of a cabinet 400, as shown for the numbers "00" through "49" for the two left cabinets 400 in FIG. 7; or by all of cabinets 400 as a group, by working downward from top to bottom across all of shelves 410 for all cabinets 400, as shown for the numbers "50" through "99" for the two right cabinets 400 in FIG. 7.

Thus, assigning numbers by individual cabinet 400, and dividing each shelf 410 into five bins and stacking, for example, five shelves 410 to form a cabinet 400, the first cabinet would have 25 bins numbered "00" through "24", as shown in FIG. 7. A bank of four of such cabinets 400 arranged side-by-side would provide a total of 100 bins, the second cabinet 400 having bins numbered "25" through "49", the third cabinet 400 having bins numbered "50" through "74", and the fourth cabinet 400 having bins numbered "75"0 through "99".

Folders 200 are assigned to the bin having the same number as the last two digits of the VIN. Because the VIN's are substantially random, folders 200 will be substantially evenly divided amongst the bins. Thus, if there are 500 folders, each bin would be expected to have five folders.

The goal of the present method is to have many equally sized bins which each contain a manageable number of folders 200. Generally, a bin size of 100 folders or fewer can be thought of as manageable. As the number of folders in a bin begins to exceed 100, the amount of searching necessary to locate a misfiled folder within that bin increases. Thus, when the number of folders 200 increases beyond 10,000 (that is, 100 folders multiplied by 100 bins), it is preferable to increase the number of bins. This can easily be accomplished by using three digits, rather than two digits, to identify each bin, and by filing folders 200 in accordance with the last three digits of the VIN. In the method according to the invention, the last two or three digits of the VIN identify only in which bin a folder 200 should be filed. Within each bin, each folder 200 is filed sequentially on the entire six digits of the VIN which are placed on tab 270.

Because each number of a label 100*c* is coded to a unique color, a misfiled folder 200, that is, a folder whose last two or three digits do not match the number of the bin, will stand out, each group of "like" digits in a row in each bin having its own color pattern. By periodically visually scanning all of the individual bins, all misfiled folders 200 can be readily identified. Even if a folder 200 is misfiled within a bin, the manageable size of each bin limits significantly the number of folders 200 which need to be examined to find the misfiled folder.

By filing based on the last six digits of the VIN, any individual folder 200 can be easily retrieved or refiled. However, there is also a need to retrieve groups of folders 200 having one or more common criteria. These criteria may vary according to the dealership, but may include the year and make of the car, extended warranty participation, the month of inspection, etc. Labels 100*a*, 100*b*, and 100*d* coded for these criteria can be placed in the supplementary information-receiving areas 292 of folders 200.

Modifications and variations of the above-described embodiments of the present invention are possible, as appreciated by those of skill in the art in light of the above teaching. For example, the filing system can be modified for use by other than automobile dealerships to accommodate information relevant to the use, and the method can be modified for filing of articles by any substantially random numbers. In general, where the random numbers have at least $x_1$ digits, the storage space for the articles is divided into bins which are assigned sequential numbers having at least $x_2$ digits, the sequential numbers starting at zero and all having the same number of digits, and $x_1-x_2$ being at least 1. The articles are then filed in the bin whose sequential number is the same as the last $x_2$ digits of the random number assigned to the article.

It is therefore to be understood that within the scope of the appended claims and their equivalents, the invention may be practiced otherwise than as specifically described.

What is claimed is:

1. A coded filing system comprising:

a plurality of coded labels of different sizes, said labels having a front section and a back section, said labels having visually-perceptible characteristics corresponding to specific alphanumeric information; and a folder having a front cover and a back cover, each of said covers having an inner face, an outer face, opposed top and bottom edges and opposed side edges, three of said edges of said back cover being aligned with the corresponding edges of said front cover, and the other of said edges of said back cover having a unitary flap extending substantially the entire length thereof outwardly of the corresponding edge of said front cover, said flap having front and back faces unitary with said inner and outer faces, respectively, of said back cover, a unitary tab extending outwardly therefrom along a portion of its length, and a plurality of placement guide means marked on said front face thereof corresponding in size to said front section of said labels for guiding placement of said front section of said labels on said front face of said flap, said front and back faces of said flap having sufficient widths to receive said front and back sections, respectively, of said labels, and at least some of said placement guide means being positioned on said tab;

wherein said tab defines a location for the placement of primary information, and the remaining portions of said flap define locations recessed from said tab for the placement of supplemental information.

2. An alphanumeric color-coded filing system comprising:

a plurality of alphanumeric, color-coded labels of different sizes, said labels having a front section, a back section, and a color-coded section overlapping at least a portion of said front and back sections, the size of each of said labels in conjunction with the size and color of said color-coded section corresponding to specific alphanumeric information; and a folder having a front cover and a back covers, each of said covers having an inner face, an outer face, opposed top and bottom edges and opposed side edges, three of said edges of said back cover being aligned with the corresponding edges of said front cover, and the other of said edges of said back cover having a unitary flap extending substantially the entire length thereof outwardly of the corresponding edge of said front cover, said flap having front and back faces unitary with said inner and outer faces, respectively, of said back cover, and a plurality of placement guide means marked on said front face thereof corresponding in size to said front section of said labels for guiding placement of said front section of said labels on said front face of said flap, said front and back faces of said flap having sufficient widths to receive said front and back sections, respectively, of said labels;

wherein said flap includes a unitary tab extending outwardly therefrom along a portion of its length, and wherein at least some of said placement guide means are positioned on said tab; and wherein said tab defines a location for the placement of primary information, and the remaining portions of said flap define locations recessed from said tab for the placement of supplemental information.

3. The filing system of claim 2, wherein at least one of said front and back sections of at least some of said labels has said specific alphanumeric information marked thereon.

4. The filing system of claim 2, wherein said front and back sections of said labels have said specific alphanumeric information marked thereon.

5. The filing system of claim 2, wherein one of said front and back covers has marked thereon a form for the entry of at least some of said alphanumeric information represented by said labels.

6. The filing system of claim 2, wherein at least some of said placement guide means are positioned adjacent each other to receive labels representing a sequence of alphanumeric information.

7. The filing system of claim 2, wherein said tab is positioned centrally on said flap.

8. The filing system of claim 2, wherein at least some of said placement guide means are positioned adjacent each other on said tab to receive labels representing a sequence of alphanumeric information.

9. The filing system of claim 2, wherein said front and back covers are joined together along their bottom edges, and wherein said flap extends from one of said side edges of said back cover.

* * * * *